US007334273B2

(12) United States Patent
Thomas

(10) Patent No.: US 7,334,273 B2
(45) Date of Patent: Feb. 26, 2008

(54) PORTABLE POPUP POTTY AND DISPOSABLE BAG

(76) Inventor: Annie L. Thomas, 4856 N. Avers, Chicago, IL (US) 60625

( * ) Notice: Subject to any disclaimer, the term of this patent is extended or adjusted under 35 U.S.C. 154(b) by 216 days.

(21) Appl. No.: 11/030,242

(22) Filed: Jan. 7, 2005

(65) Prior Publication Data

US 2006/0150313 A1 Jul. 13, 2006

(51) Int. Cl.
*A47K 11/04* (2006.01)

(52) U.S. Cl. ..... 4/483

(58) Field of Classification Search ..... 4/476–479, 4/483–485, 465, 474
See application file for complete search history.

(56) References Cited

U.S. PATENT DOCUMENTS 1,663,966 A * 3/1928 Ament et al. ..... 4/484
2,974,321 A * 3/1961 Salka ..... 4/476
4,947,493 A * 8/1990 Salonica ..... 4/476

* cited by examiner

*Primary Examiner*—Charles E. Phillips

(57) ABSTRACT

A portable collapsible potty has a seat that is supported on two wide hinged legs fitted with lever handles to effect a simple one step deployment of the unit into ready-for-use position. When collapsed, the unit may be contained in a decorative shell that disguises the function of the potty, presenting to the world the appearance of a purse or briefcase.

7 Claims, 2 Drawing Sheets

PORTABLE POPUP POTTY AND DISPOSABLE BAG

BACKGROUND OF THE INVENTION

It is desirable to toilet train children as rapidly as possible, at least from the parents' perspective. On the road, however, there may not be suitable toilet equipment available for the young child, that he might habituate and accustom himself to good habits in an independent and mature manner. The present invention addresses this need.

SUMMARY OF THE INVENTION

A toilet seat is supported on wide hinged legs that are inwardly foldable so that the toilet assembly can collapse into a compact, easily portable configuration for travel, or be easily and quickly put into use through a simple one step process of re-extending the legs so the toilet seat is in raised position. The base shell of the toilet in conjunction with a mating top cover may be formed to look like a purse or briefcase to spare the child embarrassment while carrying the potty. A potty should be acceptable to the child as well as easily and quickly put into operation for best training results.

DETAILED DESCRIPTION OF THE INVENTION

Figure 1:
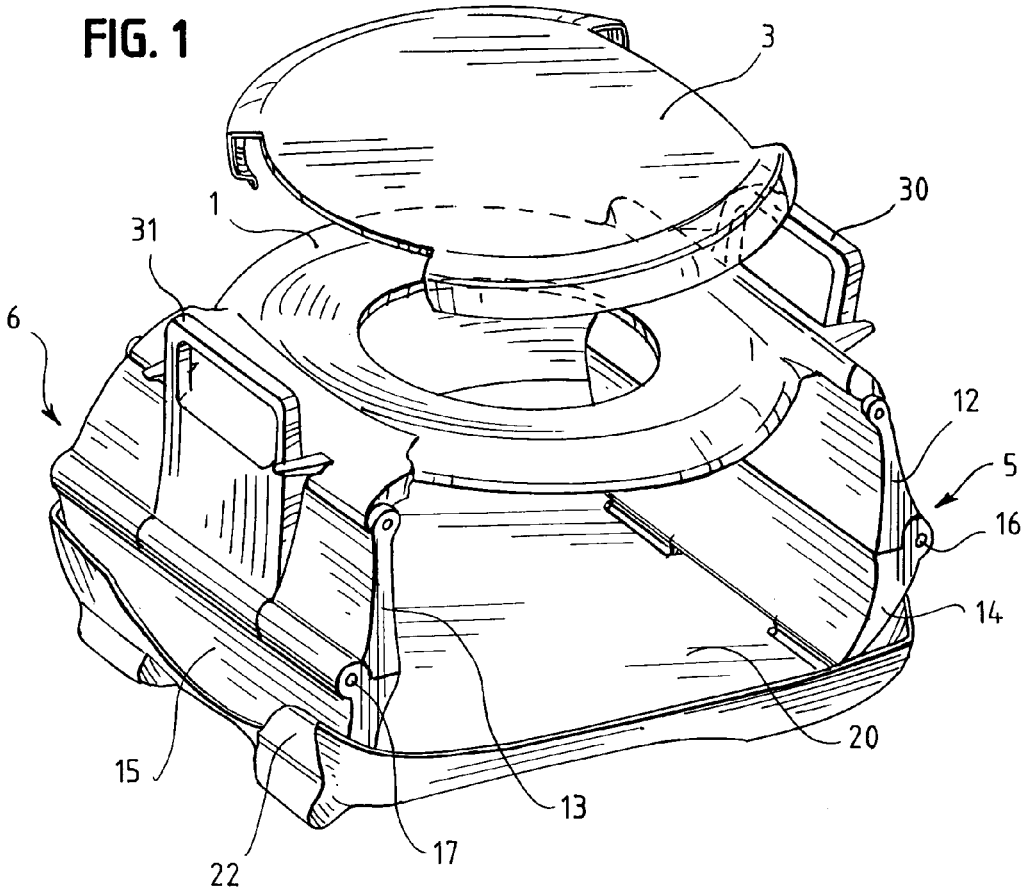
FIG. 1 is a perspective view of the potty in raised position.
Figure 2:
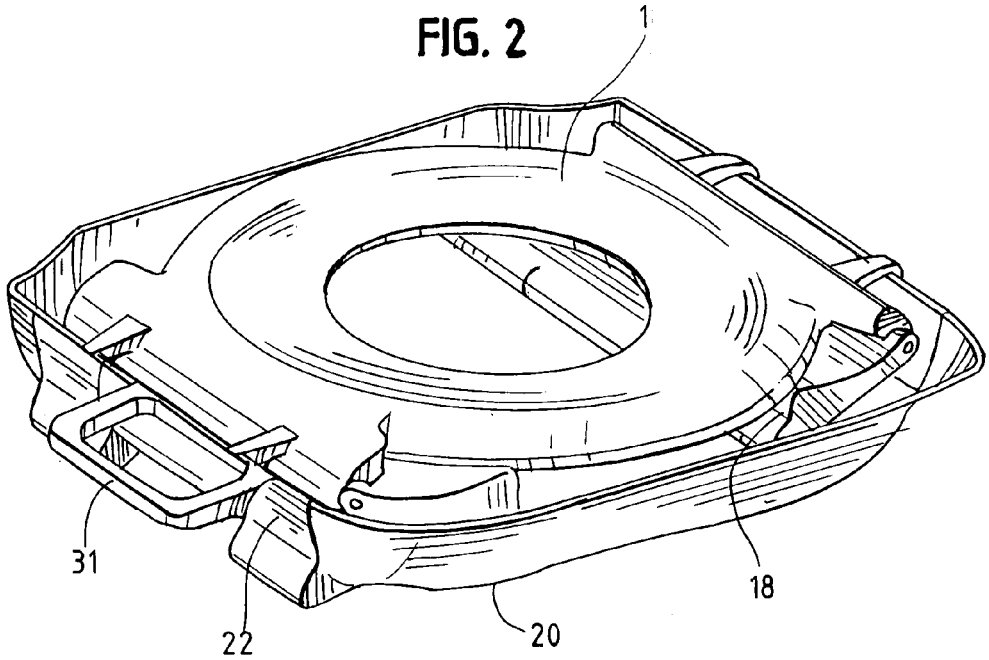
FIG. 2 shows the potty collapsed for carrying.

Referring to FIGS. 1 and 2, potty seat 1 is held up for use on wide hinged legs 5 and 6, which fold inward to collapse the potty chair for portability. It is shown with the legs 5 and 6 extended in FIG. 1 and folded in FIG. 2 to collapse the potty for transportation. By "extended" is simply meant that the leg segments 12 and 14 and the corresponding segments of the other leg lie in roughly a straight line to support the toilet seat for use. By "folded" is meant that the leg segments are roughly parallel to each other as shown in FIG. 2 where the potty is in collapsed position. The hinged legs are pivotally connected at their bottom ends to the shell base 20 and at their top ends to the potty seat 1, the hinge joint lying between the two pivots. The legs should be of sufficient width to prevent forwards and backwards motion (relative to a sitting child) of the potty seat when a child is seated thereon.

An equivalent construction to a wide hinged leg might be two hinged legs on either side of the seat, or two legs on either side connected by a crossbar. While this invention is primarily designed for use with small children for toilet training, a sturdier version for adults would be useful for such application as camping or travelling.

Lid 3 fits over the top of the toilet seat to disguise the function of the device in public if desired.

Various means can be used to stabilize the wide hinged legs when they are in raised position against side-to-side motion or folding under load. In the embodiment of FIGS. 1 and 2, the upper segments 12 and 13 and lower segments 14 and 15 of the wide hinged legs broaden to the inside as they near the hinge pivot points 16 and 17, terminating in flats such as surface 18 of FIG. 2 that are roughly perpendicular to the legs, so that when the legs are in raised position the broadened end surfaces of the hinged leg segments come together at the flats to keep the legs from folding outwards.

To prevent inward folding under load, the hinged legs are bowed to the outside slightly. The legs may be shaped in this manner, or the plane of the flats such as 18 could make an angle with the legs slightly more acute than 90 degrees to accomplish the same end.

The legs abut against raised stop portions such as 22 of the shell base to prevent side to side shifting (relative to a sitting child) of the toilet seat.

Referring to FIG. 2, the legs 5 and 6 of FIG. 1 can be manipulated into their extended position so that the potty is ready for use by lifting the toilet seat 1. Referring to FIG. 1, the legs can be put into their folded position by pushing in where the legs are hinged. The upper segments 12 and 13 of the hinged legs may be fitted with or molded with integral in-line lever handles 30 and 31 which may be pulled upwards and inwards to effect an easy one step raising of the potty seat from collapsed position to its in use position. These handles can also be used for carrying the potty.

Figure 3:
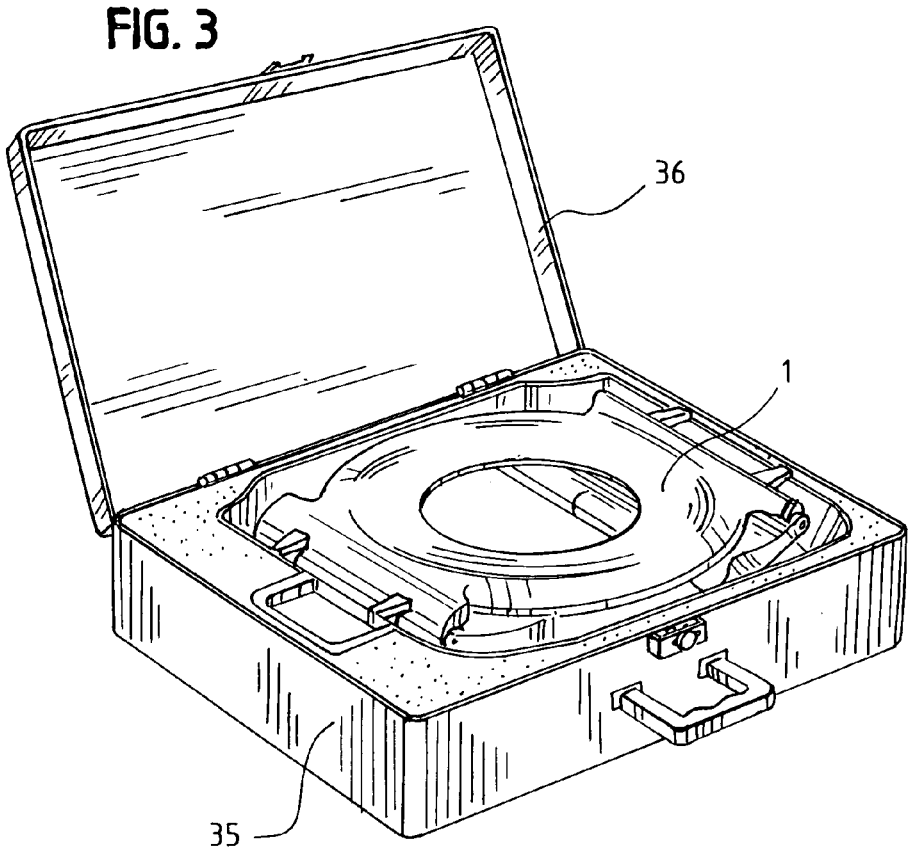
FIG. 3 shows the potty disguised as a briefcase.

It is especially desirable that children be not embarrassed carrying a potty about, which might hinder their enthusiasm for toilet training. Referring to FIG. 3, in this view, the shell base (item 20 of FIGS. 1 and 2) is extended and made into the shape of part of a briefcase 35, which is used in conjunction with lid 36, made in the shape of the other section of the briefcase, to disguise the potty chair. Parts 35 and 36 could also be made to look like purse sections for girls, or simply made in a functional shape to cover the potty and disguise its function.

Figure 4:
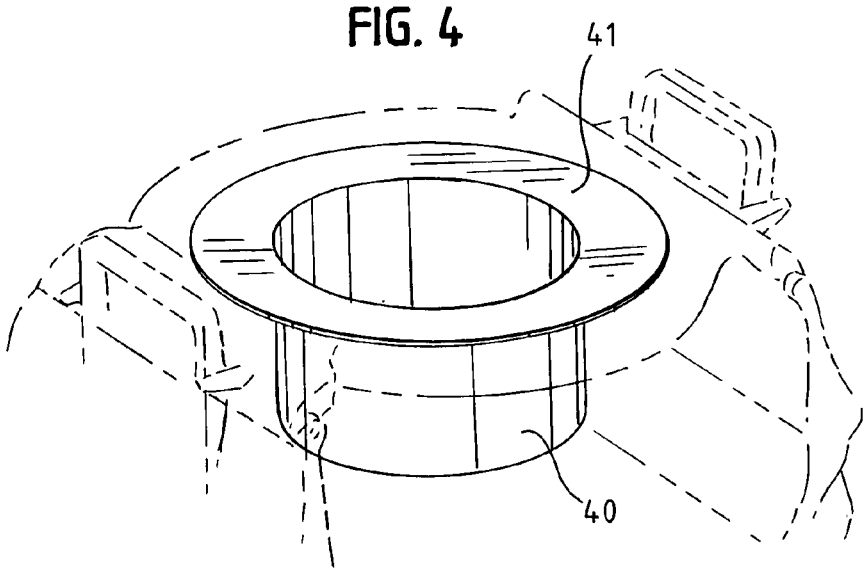
FIG. 4 shows the disposable bag used with the invention.

Referring to FIG. 4, a disposable bag for use with the potty comprises a bag section 40 that is attached at its neck to a flange 41 that sits on top of the seat to hold up the bag section. It is desirable for cleanliness that the flange be wide enough to substantially cover the potty seat. The bag should be waterproof and preferably contain absorbent material.

I claim:

1. A portable potty comprising:

a potty seat;

a shell base;

at least two hinged legs, each leg comprising an upper segment and a lower segment connected at a hinge pivot point near the center of the leg, said legs being pivotally connected at their bottom ends to the base shell and at their top ends to the potty seat, said legs supporting the potty seat when extended and collapsing the potty when folded, and said legs being wide enough to stabilize the potty seat against forward and backwards motion; and wherein the hinged legs are bowed to the outside to prevent inward folding of the legs under load, and upper and lower segments of the wide hinged legs broaden to the inside as they near the hinge pivot points, terminating in flat surfaces roughly perpendicular to the legs, so that when the legs are in raised position the broadened end surfaces of the hinged leg segments come together at the flats to keep the legs from folding outwards, and wherein the legs abut against raised stop portions of the shell base to prevent side to side shifting of the toilet seat.

2. The potty of claim 1, wherein the legs fold inward, the upper segments of said legs having attached thereto or integral therewith lever handles in-line with these upper segments thereby enabling an easy one-step raising of the potty seat by pulling the handles upwards and inwards.

3. A portable potty comprising:

a potty seat;

a shell base;

at least two hinged legs, each leg comprising an upper segment and a lower segment connected at a hinge pivot point near the center of the leg, said legs being pivotally connected at their bottom ends to the base shell and at their top ends to the potty seat, said legs supporting the potty seat when extended and collapsing the potty when folded, and said legs being wide enough to stabilize the potty seat against forward and backwards motion; and wherein the legs fold inward, the upper segments of said legs having attached thereto or integral therewith lever handles in-line with these upper segments, thereby enabling an easy one-step raising of the potty seat by pulling the handles upwards and inwards.

4. The potty of claim 3, further comprising a disposable bag that comprises a bag section that receives waste and a flange section that sits on top of the potty seat to hold up the bag section.

5. The potty of claim 4, wherein the flange section is wide enough to cover most of the potty seat for cleanliness.

6. The potty of claim 3, further comprising an outer shell covering the potty when it is collapsed to hide the function of the potty so that it can be carried by children without embarrassment.

7. The potty of claim 6, wherein the outer shell looks like a briefcase or purse.

* * * * *